United States Patent [19]

Roman

[11] Patent Number: 4,457,471

[45] Date of Patent: Jul. 3, 1984

[54] SWIVEL ARM IRRIGATOR

[75] Inventor: Gianfranco Roman, Pasiano, Italy

[73] Assignee: Claber S.p.A., Pordenone, Italy

[21] Appl. No.: 443,029

[22] Filed: Nov. 19, 1982

Related U.S. Application Data

[63] Continuation of Ser. No. 361,604, Mar. 25, 1982, abandoned, which is a continuation of Ser. No. 159,284, Jun. 13, 1980, abandoned.

[30] Foreign Application Priority Data

Jun. 26, 1979 [IT] Italy ..... 21950/79[U]

[51] Int. Cl.[3] ..... B05B 3/14

[52] U.S. Cl. ..... 239/242

[58] Field of Search ..... 239/242, 600; 403/361

[56] References Cited

U.S. PATENT DOCUMENTS

| | | | |
|---|---|---|---|
| 2,191,688 | 2/1940 | Thau | 285/280 |
| 2,886,250 | 5/1959 | Smith et al. | 239/242 |
| 3,175,770 | 3/1965 | Johnson | 239/242 |
| 3,578,248 | 5/1971 | Congdon et al. | 239/242 |
| 3,698,748 | 10/1972 | Petri | 403/361 |
| 4,025,045 | 5/1977 | Kubiak | 239/600 |

*Primary Examiner*—John J. Love

*Attorney, Agent, or Firm*—Diller, Ramik & Wight, Ltd.

[57] ABSTRACT

A swivel arm irrigator includes a tubular swivel arm with radial bores and a support structure formed by two straight metal arms parallel to the axis of rotation of the swivel arm and by two substantially triangular side pieces disposed at the ends of the swivel arm and the metal arms. The ends of the straight metal arms are extractably housed in corresponding seats of the side pieces.

6 Claims, 6 Drawing Figures

SWIVEL ARM IRRIGATOR

This application is a continuation, of application Ser. No, 06/361,604, filed Mar. 25, 1982 now abandoned which is a continuation of Ser. No. 159,284 filed June 13, 1980 now abandoned.

This invention relates to a swivel arm irrigator usable for irrigating lawns, fields, gardens and cultivated ground in general.

Swivel arm irrigators are based or the use of a tubular swivel arm into which irrigation water is fed, and leaves in the form of individual adjacent jets through a succession of radial bores distributed along the swivel arm. The swivel arm is generally driven by the actual irrigation water, which by means of a suitable turbine causes continuous rotation of a drive shaft connected to the swivel arm by a connection rod-crank transmission system. This latter is sometimes of fixed type (usually used in the cheaper models) and sometimes of adjustable type to enable the position of the dead centres of the arm swivel motion to be correspondingly adjusted.

Known irrigators of this type are described in U.S. patent application No. 944,138 filed on Sept. 20, 1978 now U.S. Pat. No. 4,218,017 and in the U.S. patent application No. 972,232 filed on Dec. 22, 1978 now U.S. Pat. No. 4,232,827, in which the swivel arm support structure is in the form of two U-shaped metal tubular elements which extend beyond the length of the swivel arm, their ends converging on one side towards a small triangular connection piece which rotatably supports one end of the swivel arm, and on the other side towards a box containing the turbine and rotatably supporting the other end of the swivel arm.

Such a support structure cannot be dismantled and reassembled, which means that the irrigators have to be despatched by the factory to the points of sale, or possibly directly to the users, already completely assembled and thus in a rather bulky state. In addition, the spare parts to be kept in store must include the entire irrigator already assembled (and thus bulky), rather than just those parts most subject to fracture and wear. Finally, the U configuration of the metal tubular elements requires rather lengthy and costly machining, which cannot be reconciled with the requirement for manufacturing models as cheaply as possible.

The object of the present invention is to provide a swivel arm irrigator in which the aforesaid drawbacks are obviated, and in particular which is simple, economical, easily dismantled and reassembled.

This object is attained according to the invention by a swivel arm irrigator, comprising a swivel arm support structure formed from two straight metal bars disposed parallel to the axis of rotation of the swivel arm, and two substantially triangular side pieces disposed at the ends of said swivel arm end of said metal bars, and each having a first vertex provided with releasable means for removably and rotatably supporting one respective end of the swivel arm, and a second and third vertex provided with recess seats for extractably housing corresponding ends of said metal bars, one of said side pieces including control means for the motion of said swivel arm and means for feeding irrigation water into said swivel arm.

One embodiment of the irrigator according to the invention is illustrated for greater clarity in the accompanying drawings, in which.

The irrigator illustrated on the drawings comprises essentially a curved swivel arm 1 and a support structure 2 which supports it in such a manner as to leave it free to rotate about a longitudinal axis passing through the aligned ends of said arm.

Figure 1:
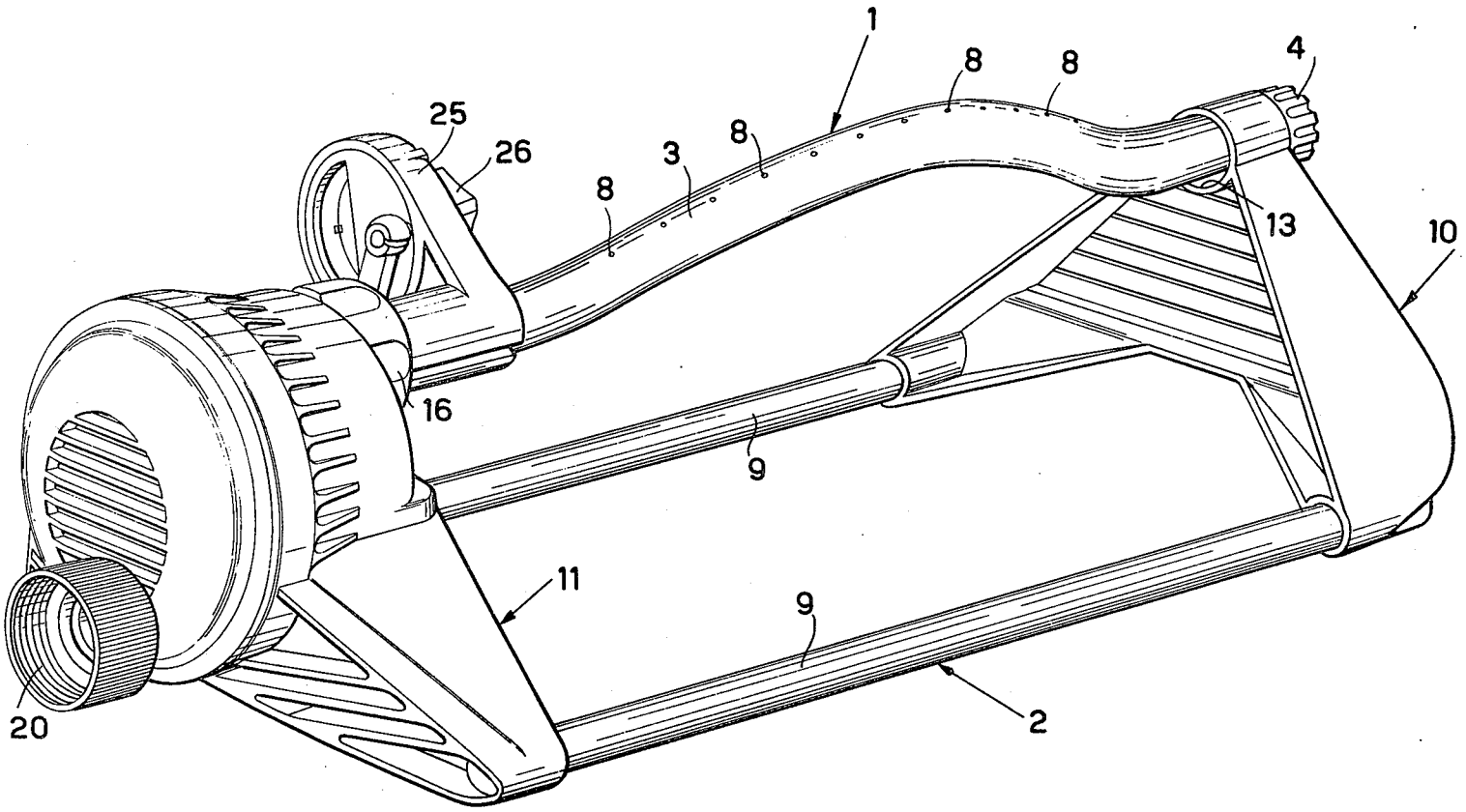
FIG. 1 is a first perspective representation of said irrigator according to the invention.
Figure 2:
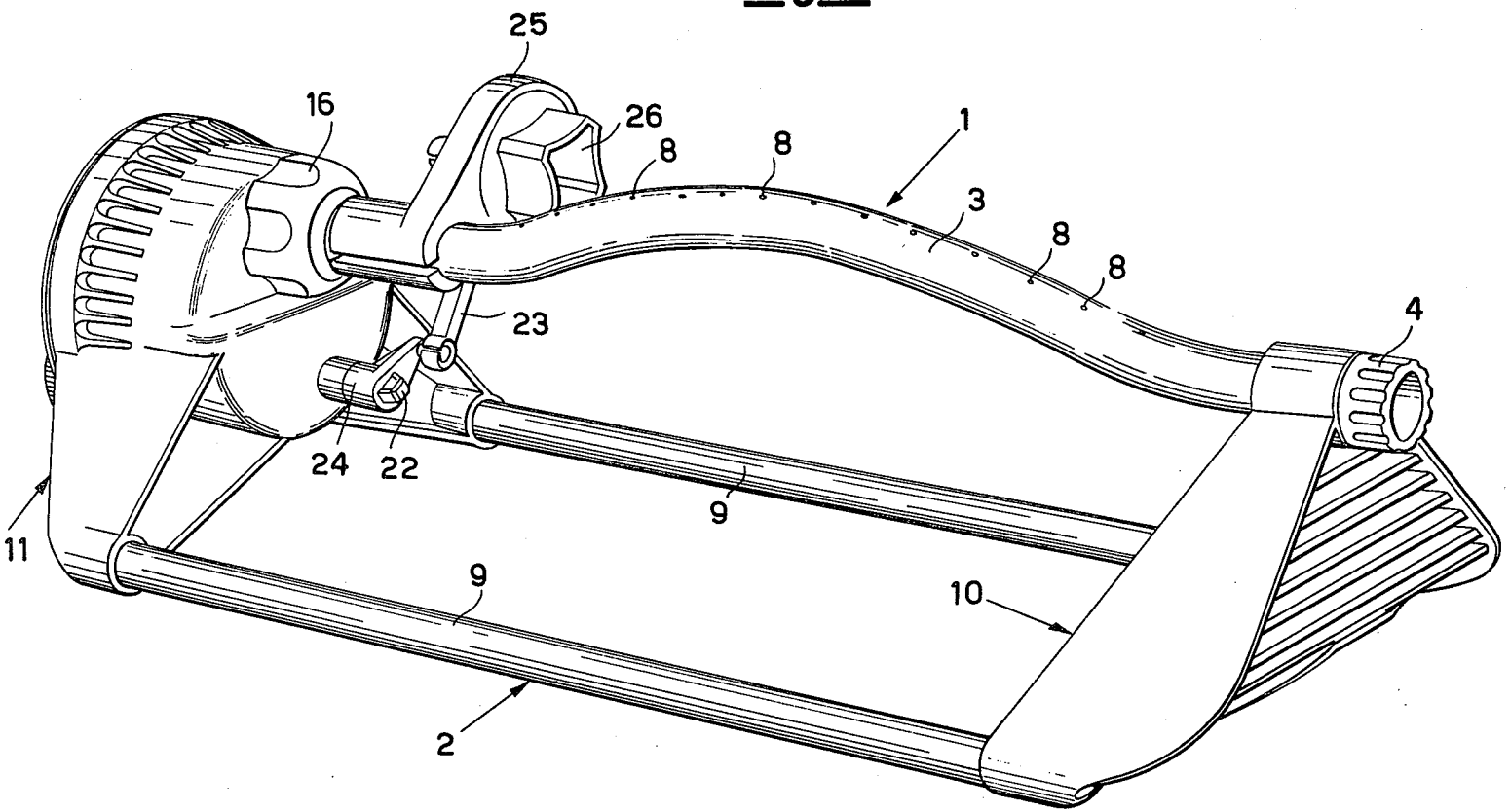
FIG. 2 is a second perspective representation of said irrigator.
Figure 6:
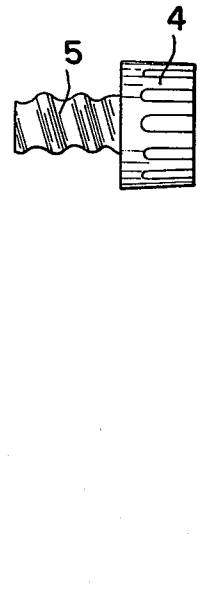
FIG. 6 is an exploded view of the same assembly as shown in FIG. 5.
Figure 6:
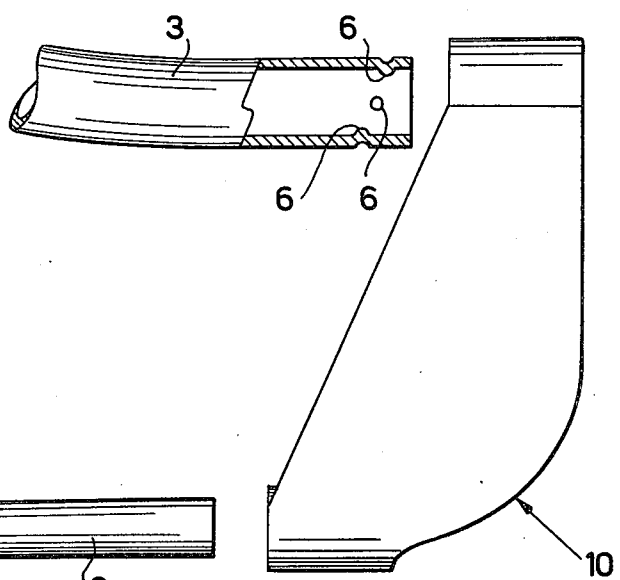
Figure 5:
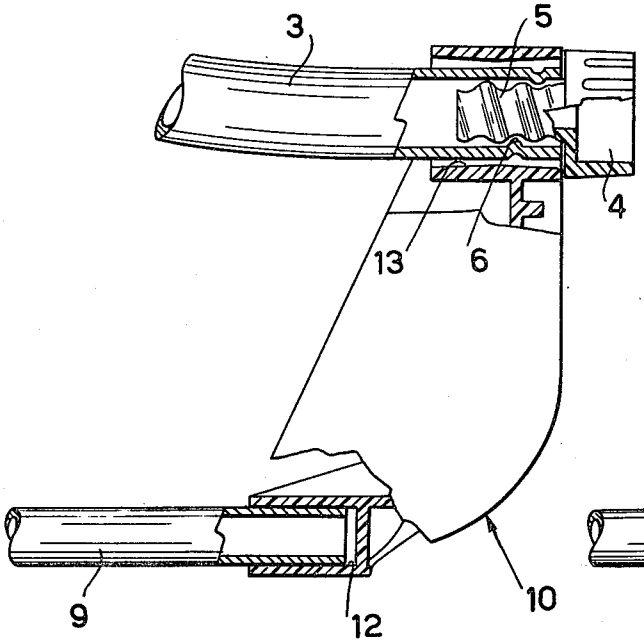
FIG. 5 is a partly full and partly sectional view of the other side piece of said irrigator together with the relative ends of the swivel arm and one of the metal connection bars.

The swivel arm 1 consists of a metal tube 3 which is closed at one end by a plug 4 comprising a threaded shank 5 engageable with internal projections 6 on said end (FIGS. 5 and 6), and is open at its other end, and in addition is provided with a flange 7 (FIG. 3), and receives irrigation water fed in the manner described hereinafter. a succession of radial bores 8 distributed along the swivel tube 3 (FIGS. 1 and 2) enables said water to escape in the form of individual adjacent jets.

Figure 3:
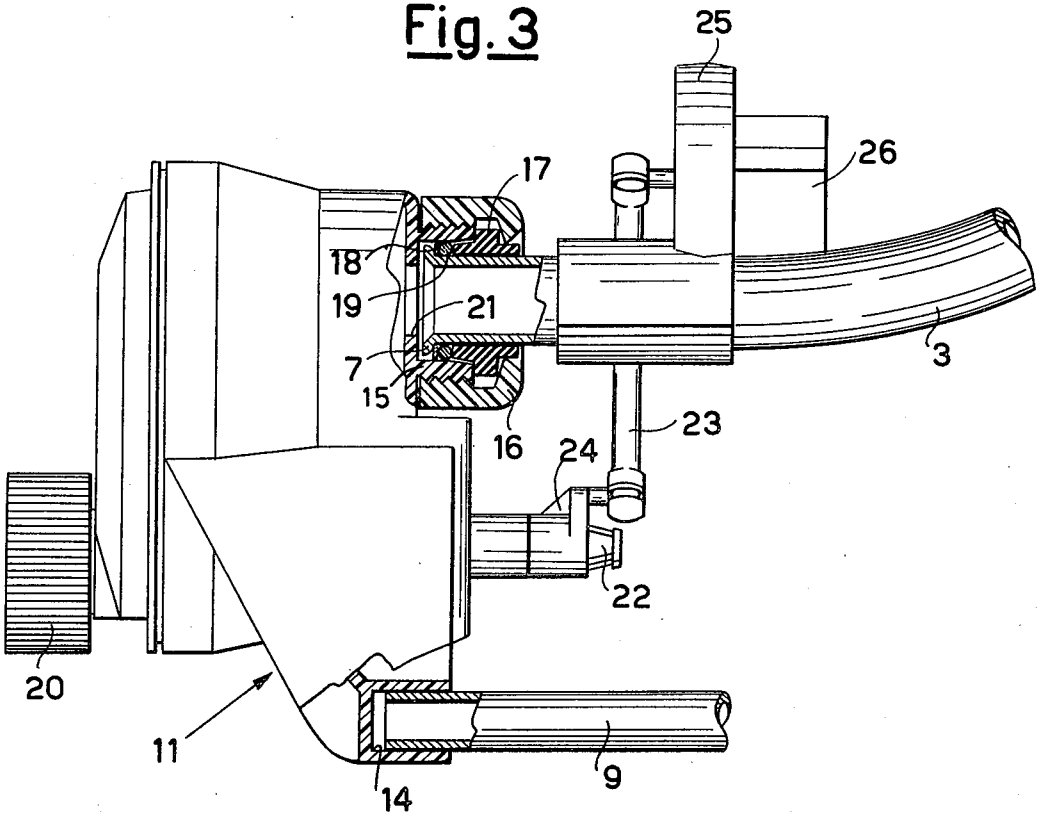
FIG. 3 is a partly full and partly sectional view of one of the side pieces of said irrigator together with the relative ends of the swivel arm and one of the metal connection bars.
Figure 4:
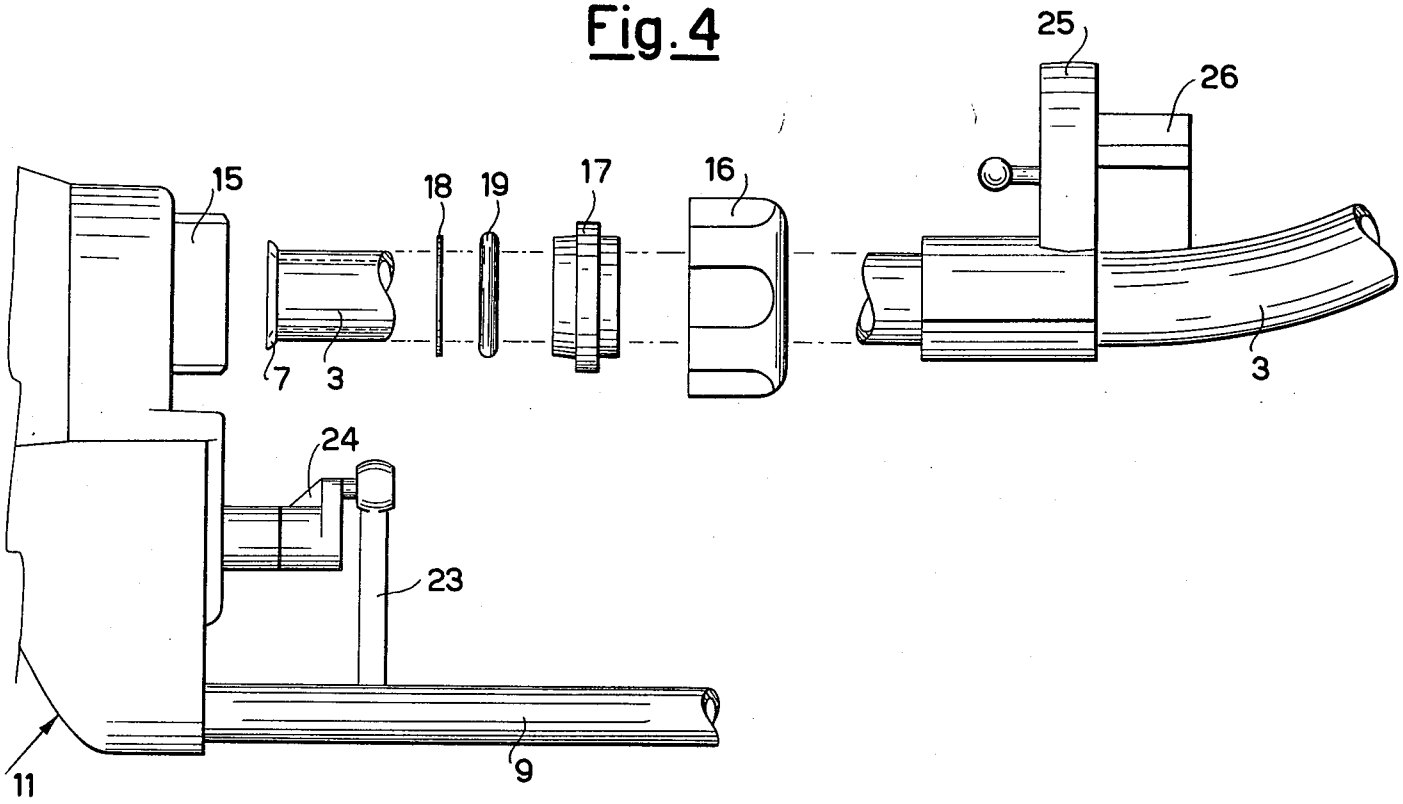
FIG. 4 is an exploded view of the same assembly as shown in FIG. 3.

The support structure 2 comprises two straight metal bars 9 disposed parallel to the axis of rotation of the swivel arm, and two side pieces 10 and 11 both of substantially triangular shape. The side pieces 10 act only as a terminal support for the swivel arm 1, and comprise two vertices provided with recess seats 12 into which corresponding ends of the metal bars 9 are releasably forced, and a further vertex provided with a through bore 13 into which the end of the swivel tube 3 is rotatably inserted, and is closed by the plug 4 (also acting as releasable connection means between the swivel arm 1 and side piece 10). The side piece 11 acts both as a terminal support for the arm 1 and as a box for containing control means for the rotation of the arm and means for feeding the water into said arm. In this respect, it comprises two vertices provided with recess seats 14 completely similar to the seats 12 of the side piece 10, and constituting a releasable housing for the other ends of the metal bars 9 (FIG. 3), and a further vertex comprising an end-threaded projecting tubular shank 15 in which the other end of the swivel tube 3 is rotatably and releasably inserted. As shown in FIGS. 3 and 4, the releasable connection between said other end of the swivel tube and the side piece 11 is made with the aid of a threaded ring nut 16, which is screwed on to the threaded periphery of the tubular shank 15 and clamps against it a bush 17 acting as a stop element for a metal washer 18 and a ring gasket 19 disposed about the end of the tube 3 immediately before the end flange 7.

With regard to the other function of the side piece 11, i.e. for containing the motion control means and the means for feeding water, it should be noted that said means are of a completely conventional type, in particular as illustrated in the U.S. Pat. application Ser. No. 972,232 filed on Dec. 22, 1978 now U.S. Pat. No. 4,232,827 because of which they are neither illustrated nor described here in detail. It need only be stated that in conformity with said patent application, they comprise a turbine which receives the water fed from the mains through a threaded nozzle 20, and before the water reaches the flanged end of the swivel tube 3 (FIG. 3) by way of a bore 21, the turbine utilises the thrust in order to cause a drive shaft 22 emerging from the side piece 11 parallel to the swivel tube 3 (FIGS. 2–4) to continuously rotate at constant speed by way of suitable motion transmission gears. Said drive shaft is connected to the swivel tube 3 by a transmission system comprising a connection rod 23 and cranks 24 and 25, which converts the continuous rotary motion of the shaft 22 into a reciprocating rotary motion of the arm 3. In the example illustrated on the drawings, said transmission system is of adjustable type, i.e. it is possible by means of a rotatable knob 26 to adjust the position of the dead centres of the swivel motion. However, it is also possible to use a non-adjustable type if required, for price reduction reasons.

Although the method of operation of the irrigator illustrated on the drawings will not be described in detail as it is completely identical to that of the irrigators described in said patent applications, it is however important to emphasise the advantages deriving from the new support structure for the swivel arm. In particular, it should be noted that it can be easily and rapidly dismantled and separated into the two side pieces 10 and 11 and the two bars 9 by unscrewing the plug 4 and ring nut 16, and withdrawing the ends of the bars 9 from the recess seats 12 and 14 of the two side pieces. The irrigator can thus be despatched in a completely dismantled state in a box ready for assembly, with consequent advantages from the overall size aspect during transport. Furthermore, it is thus possible to mainly carry in stock those spare parts most subject to fracture or wear, such as the side piece 11 with its motion control and water feed means, while limiting the number of spare parts for the other parts of the irrigator. This also gives considerable benefits in terms of overall bulk. Finally, it is possible to use the same side pieces 10 and 11 in combination with arms 1 and bars 9 of different lengths in order to rapidly prepare models of different lengths.

The importance of the new straight configuration of the metal bars 9 should also be noted, as these obviously require a much more simple and thus less costly machining.

Finally, the replaceability of the adjustable motion transmission system by one of fixed type constitutes a further advantage from the cost aspect, in the sense that it enables a particularly low-cost model to be rapidly prepared by using the same elements as the other models for the remaining part.

I claim:

1. A swivel arm irrigator comprising a tubular swivel arm with radial bores, a support structure for supporting said swivel arm for oscillating about a longitudinal axis, said support structure including at least one bar and first and second ground-engaging side pieces disposed at ends of said swivel arm and at ends of said bar with said swivel arm and bar generally spanning the distance between said side pieces, said first and second side pieces having respective first and second releasable securing means for removingly and rotatably supporting respective first and second ends of said swivel arm relative to said respective first and second side pieces, said first and second side pieces having respective first and second means for defining first and second recesses opening toward each other for receiving respective first and second ends of said bar, said first side piece including control means for oscillating said swivel arm about said longitudinal axis, means for feeding water into said swivel arm, said first and second releasable securing means being effective when secured to said first and second swivel arms ends for holding said first and second side pieces at a predetermined distance from each other thereby holding said bar ends captive in said recesses, and at least one of said first and second releasable securing means being effective when released from its associated first and second swivel arm end to release said first and second side pieces for relative movement beyond said predetermined distance thereby allowing the withdrawal of said bar ends from said recesses.

2. The swivel arm irrigator as defined in claim 1 wherein at leasts one of said first and second releasable securing means includes a tubular threaded shank projecting from one of said first and second side pieces and a ring nut encircling said swivel arm, and said ring nut is in threaded engagement with said tubular threaded shank.

3. The swivel arm irrigator as defined in claim 1 wherein at least one of said first and second releasable securing means includes a tubular threaded shank projecting from one of said first and second side pieces and a ring nut encircling said swivel arm, one of said swivel arm ends being in internal telescopic relationship to said tubular threaded shank, and said ring nut being in threaded engagement with said tubular threaded shank.

4. The swivel arm irrigator as defined in claim 1 wherein at least one of said first and second releasable securing means includes a thread at one of said swivel arm ends and a threaded fastener secured thereto, said one swivel arm end being rotatably mounted in another recess of one of said side pieces, and said threaded fastener retaining said one swivel arm end in said another recess.

5. The swivel arm irrigator as defined in claim 2 wherein a second of said first and second releasable securing means includes a thread at the other of said swivel arm ends and a threaded fastener secured thereto, said another swivel arm end being rotatably mounted in another recess of another of said side pieces, and said threaded fastener retains said another swivel arm end in said another recess.

6. The swivel arm irrigator as defined in claim 3 wherein at least one of said first and second releasable securing means includes a thread at one of said swivel arm ends and a threaded fastener secured thereto, said one swivel arm end being rotatably mounted in another recess of one of said side pieces, and said threaded fastener retaining said one swivel arm end in said another recess.

* * * * *